US007144342B1

(12) United States Patent
Van Der Pols

(10) Patent No.: US 7,144,342 B1
(45) Date of Patent: Dec. 5, 2006

(54) STRING PULLING HEAD STRUCTURE OF A RACKET STRINGER

(76) Inventor: Erik Bernard Van Der Pols, No. 847 San Feng Road, Feng Yuan, Taichung Hsien (TW)

( * ) Notice: Subject to any disclaimer, the term of this patent is extended or adjusted under 35 U.S.C. 154(b) by 0 days.

(21) Appl. No.: 11/224,003

(22) Filed: Sep. 13, 2005

(51) Int. Cl.
*A63B 51/14* (2006.01)

(52) U.S. Cl. ..... 473/557

(58) Field of Classification Search ..... 473/555–557
See application file for complete search history.

(56) References Cited

U.S. PATENT DOCUMENTS 4,125,259 A * 11/1978 Halbrook ..... 473/557
4,491,322 A * 1/1985 Heilman ..... 473/556
5,733,212 A * 3/1998 Wise et al. ..... 473/557
6,227,990 B1 * 5/2001 Wise et al. ..... 473/557

* cited by examiner

*Primary Examiner*—Raleigh W. Chiu
(74) *Attorney, Agent, or Firm*—Rosenberg, Klein & Lee

(57) ABSTRACT

A string pulling head structure of a racket stringer, including a first string chuck and a second string chuck fixed with each other and a first chucking plate and a second chucking plate disposed between the first and second string chucks. Each of the opposite faces of the first and second string chucks and the first and second chucking plates is formed with two parallel slots. An antiwear slat is disposed on one side of each of the slots to serve as the bottom of the slot. The slats are inclined by equal inclination angle but in reverse direction, whereby the depths of two ends of the slots are unequal to each other.

11 Claims, 6 Drawing Sheets

STRING PULLING HEAD STRUCTURE OF A RACKET STRINGER

BACKGROUND OF THE INVENTION

The present invention is related to a string pulling head structure of a racket stringer. Each of the opposite faces of the string chucks and the chucking plates is formed with two parallel slots. An antiwear slat is disposed on one side of each of the slots to serve as the bottom of the slot. The slats are inclined by equal inclination angle but in reverse direction. The string pulling head structure can be made at lower cost.

FIGS. 5 and 6 show a string pulling head structure of a conventional racket stringer. The string pulling head structure includes a string pulling head 7 composed of a first string chuck 71 and a second string chuck 72 mated with each other and fixed with each other by screws. A first chucking plate 73 and a second chucking plate 74 defining therebetween a chucking space 75. Springs 76 are compressed between the first and second chucking plates 73, 74 for pushing the first and second chucking plates 73, 74 to respectively attach to the first and second string chucks 71, 72. Each of the attaching faces of the first and second chucking plates 73, 74 and the first and second string chucks 71, 72 is formed with two channels 77 with inclined bottoms. The channels 77 of the first and second chucking plates 73, 74 and the first and second string chucks 71, 72 are mated with each other to together define a space for accommodating multiple steel balls 8 therein. When the first and second chucking plates 73, 74 synchronously slide, due to the inclined bottoms of the channels 77, the steel balls 8 will press the first and second chucking plates 73, 74 outward. At this time, the chucking space 75 between the first and second chucking plates 73, 74 is minified for chucking the racket string.

The steel balls 8 can roll within the channels 77 of the first and second string chucks 71, 72 and the first and second chucking plates 73, 74 to press the first and second chucking plates 73, 74. In order to enhance the antiwear capacity, the first and second string chucks 71, 72 and the first and second chucking plates 73, 74 are made of steel. In addition, the bottom of the channel 77 is generally formed with a semispherical cross-section and has a certain slope. Referring to FIG. 7, the semispherical and inclined channels 77 are formed by means of a spherical milling cutter. Due to the limitation of the material of the first and second string chucks 71, 72 and the first and second chucking plates 73, 74 and the special shape of the milling cutter, each time the milling cutter can only mill the first and second string chucks 71, 72 and the first and second chucking plates 73, 74 by a depth not exceeding 0.25 mm. Otherwise, the spherical milling cutter will be damaged. Therefore, in actual processing, it takes seven or eight minutes to mill one semispherical channel 77 and replace the milling cutter as shown in FIG. 8. The conventional string pulling head structure totally has eight channels 77. Therefore, it will take about one hour for processing. In addition, it is quite hard to keep good quality of the channels 77 in processing. Accordingly, it is time-consuming to manufacture the string pulling head and the manufacturing cost is high.

SUMMARY OF THE INVENTION

It is therefore a primary object of the present invention to provide a string pulling head structure of a racket stringer, including a first string chuck and a second string chuck and a first chucking plate and a second chucking plate. Each of the opposite faces of the string chucks and the chucking plates is formed with several slots. An antiwear slat is obliquely disposed on the bottom of each of the slots, whereby the bottom of the slot is inclined. Multiple ball members are disposed in each slot to frictionally abut against the antiwear slat. Therefore, the string chucks and the chucking plates can be made of aluminum or engineering plastic to lower the cost for the material. Moreover, when processing the string chucks and the chucking plates, an ordinary milling cutter can be used instead of the conventional spherical milling cutter to quickly form the slots without considering the slope of the bottom of the slot. Therefore, the processing can be speeded and thus the manufacturing time and cost are greatly reduced.

According to the above object, the string pulling head structure of the present invention includes:

a first string chuck and a second string chuck fixed with each other and a first chucking plate and a second chucking plate disposed between the first and second string chucks, outer faces of the first and second chucking plates respectively attaching to inner faces of the first and second string chucks, inner faces of the first and second chucking plates being respectively a first chucking face and a second chucking face, the first and second chucking faces defining therebetween a gap, the inner face of the first string chuck being formed with more than one first slot, the outer face of the first chucking plate being formed with more than one first slot mated with the first slot of the first string chuck, multiple ball members being accommodated in the first slots, the inner face of the second string chuck being formed with more than one second slot, the outer face of the second chucking plate being formed with more than one second slot mated with the second slot of the second string chuck, multiple ball members being accommodated in the second slots;

a first antiwear slat disposed on outer side of the first slot of the first string chuck to seal the outer side of the first slot and another first antiwear slat disposed on inner side of the first slot of the first chucking plate to seal the inner side of the first slot, the first slats serving as the bottoms of the first slots, the first slats being inclined by equal inclination angle but in reverse direction, whereby the depths of two ends of the first slots are unequal to each other; and a second antiwear slat disposed on outer side of the second slot of the second string chuck to seal the outer side of the second slot and another second antiwear slat disposed on inner side of the second slot of the second chucking plate to seal the inner side of the second slot, the second slats serving as the bottoms of the second slots, the second slats being inclined by equal inclination angle but in reverse direction, whereby the depths of two ends of the second slots are unequal to each other.

The present invention can be best understood through the following description and accompanying drawings wherein:

DETAILED DESCRIPTION OF THE PREFERRED EMBODIMENTS

Figure 1:
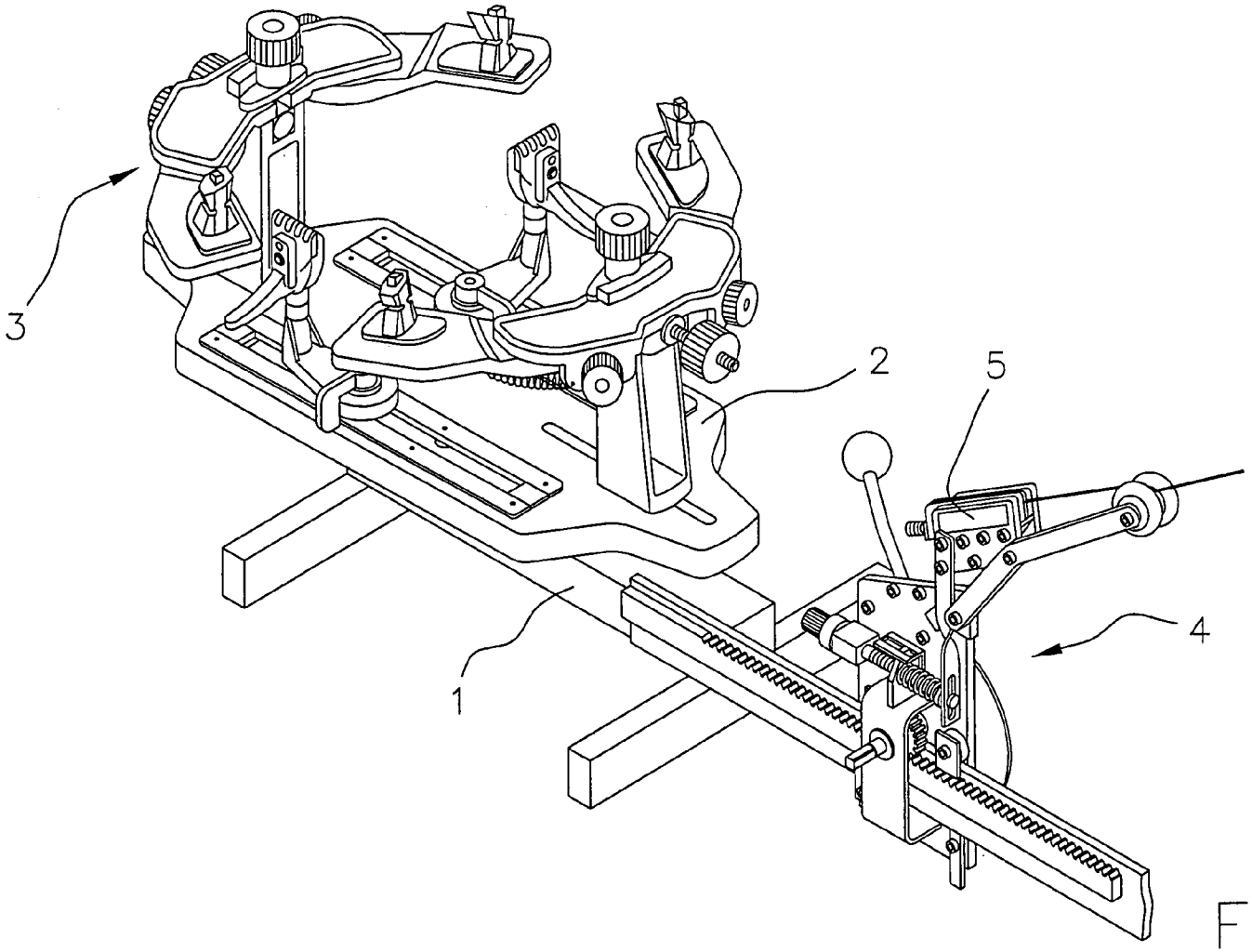
FIG. 1 is a perspective assembled view of the racket stringer of the present invention.

Please refer to FIG. 1. The racket stringer of the present invention includes a base seat 1 and a rotary bench 2 disposed on the base seat 1. A ratchet fixing device 3 is arranged on the rotary bench 2 for fixing a racket. A string chucking device 4 is mounted on the base seat 1 on one side of the rotary bench 2 for pulling the string. A string pulling head structure 5 is disposed at top end of the string chucking device 4 for chucking the string.

Figure 2:
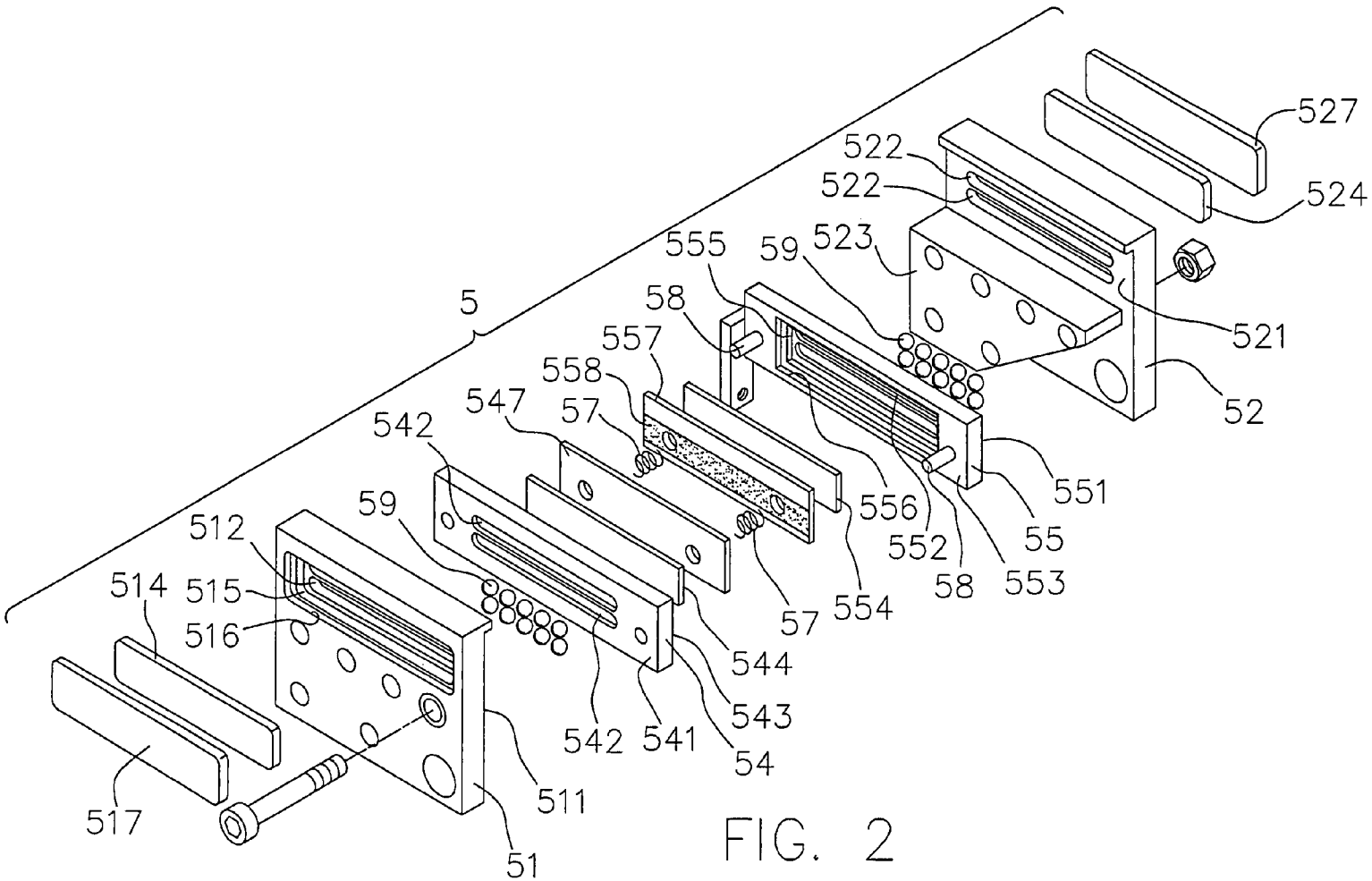
FIG. 2 is a perspective exploded view of the string pulling head structure of the present invention.
Figure 3:
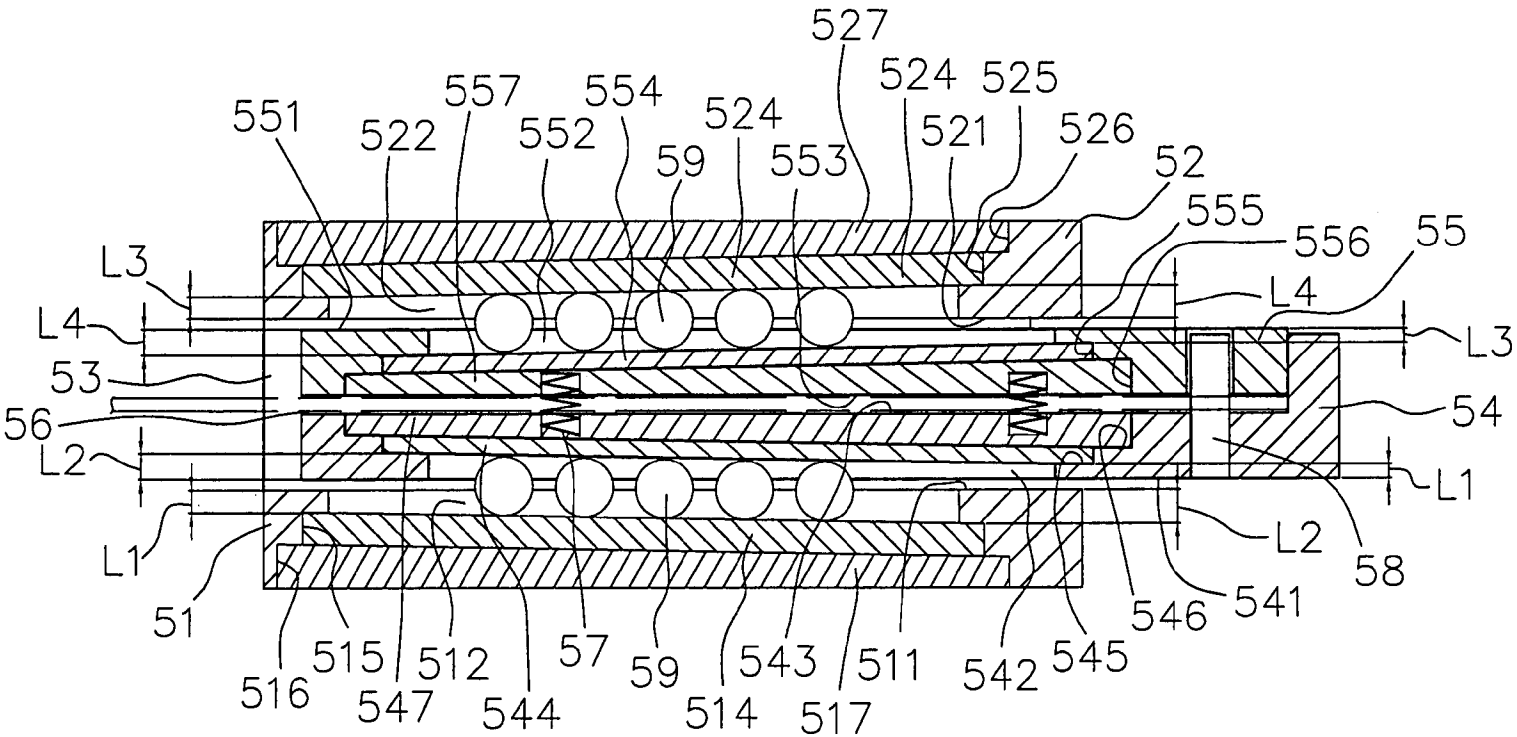
FIG. 3 is a sectional assembled view of the string pulling head structure of the present invention.

Referring to FIGS. 2 and 3, the string pulling head structure 5 includes a first string chuck 51 and a second string chuck 52 fixed with each other by screws. A projecting block 523 extends from a lower section of the second string chuck 52 toward the first string chuck 51. Accordingly, a slide way 53 is defined between opposite inner faces 511, 521 of upper sections of the first and second string chucks 51, 52. A first chucking plate 54 and a second chucking plate 55 are disposed in the slide way 53. The outer faces 541, 551 of the first and second chucking plates 54, 55 respectively attach to the inner faces 511, 521 of the upper sections of the first and second string chucks 51, 52. The inner faces of the first and second chucking plates 54, 55 respectively are a first chucking face 543 and a second chucking face 553. The first and second chucking faces 543, 553 define therebetween a gap 56. In addition, two springs 57 and two guide posts 58 are disposed between the first and second chucking faces 543, 553 for resiliently pushing and guiding the first and second chucking plates 54, 55 to attach to the inner faces 511, 521 of the first and second string chucks 51, 52.

The inner face 511 of the first string chuck 51 is formed with two first slots 512. The outer face 541 of the first chucking plate 54 is formed with two first slots 542 mated with the first slots 512 of the first string chuck 51. Multiple ball members 59 are accommodated in the first slots 512, 542. The inner face 521 of the second string chuck 52 is formed with two second slots 522. The outer face 551 of the second chucking plate 55 is formed with two second slots 552 mated with the second slots 522 of the second string chuck 52. Multiple ball members 59 are accommodated in the second slots 522, 552. A first antiwear slat 514 is disposed on outer side of the first slots 512 of the first string chuck 51 to seal the outer side of the first slots 512. A first antiwear slat 544 is disposed on inner side of the first slots 542 of the first chucking plate 54 to seal the inner side of the first slots 542. The first slats 514, 544 serve as the bottoms of the first slots 512, 542. The first slats 514, 544 are inclined by equal inclination angle but in reverse direction. Therefore, the depths L1, L2 of two ends of the first slots 512, 542 are unequal to each other. In this embodiment, the depth L2 of one end of the first slots 512, 542 is larger than the depth L1 of the other end of the first slots 512, 542. A second antiwear slat 524 is disposed on outer side of the second slots 522 of the second string chuck 52 to seal the outer side of the second slots 522. A second antiwear slat 554 is disposed on inner side of the second slots 552 of the second chucking plate 55 to seal the inner side of the second slots 552. The second slats 524, 554 serve as the bottoms of the second slots 522, 552. The second slats 524, 554 are inclined by equal inclination angle but in reverse direction. Therefore, the depths L3, L4 of two ends of the second slots 522, 552 are unequal to each other. In this embodiment, the depth L4 of one end of the second slots 522, 552 is larger than the depth L3 of the other end of the second slots 522, 552.

The structures and the arrangement manners of the first and second slats are not limited. In this embodiment, one side of each of the first slots 512, 542 of the first string chuck 51 and the first chucking plate 54 is formed with a first receiving section 515, 545 and a first depression 516, 546. The first slats 514, 544 are respectively accommodated in the first receiving sections 515, 545. Two first cover boards 517, 547 are respectively disposed in the first depressions 516, 546. In this embodiment, the first slats 514, 544 are iron boards and retained by the first cover boards 517, 547 on one side of the first slots 512, 542 of the first string chuck 51 and first chucking plate 54 to serve as the bottoms of the first slots 512, 542. One side of each of the second slots 522, 552 of the second string chuck 52 and the second chucking plate 55 is formed with a second receiving section 525, 555 and a second depression 526, 556. The second slats 524, 554 are respectively accommodated in the second receiving sections 525, 555. Two second cover boards 527, 557 are respectively disposed in the second depressions 526, 556. In this embodiment, the second slats 524, 554 are iron boards and retained by the second cover boards 527, 557 on one side of the second slots 522, 552 of the second string chuck 52 and second chucking plate 55 to serve as the bottoms of the second slots 522, 552.

According to the above arrangement, the first slots 512, 542 and second slots 522, 552 are inclined in reverse direction. When the first and second chucking plates 54, 55 move and the ball members 59 roll to the shallow ends of the first and second slots 512, 542, 522, 552, the gap 56 between the first and second chucking faces 543, 553 of the first and second chucking plates 54, 55 is minified so as to firmly chuck the racket string.

The antiwear slats are obliquely mounted on one side of the slots as the bottoms of the slots for the ball members to frictionally abut against. Therefore, the string chucks and the chucking plates can be made of aluminum to lower the cost. Moreover, when processing the string chucks and the chucking plates, an ordinary milling cutter can be used instead of the conventional spherical milling cutter to quickly form the slots and the receiving sections. Therefore, the manufacturing cost is greatly reduced.

Furthermore, the chucking face of each chucking plate can have a hardened layer 558. In this embodiment, the hardened layer 558 is made of silica sand for enhancing the frictional force of the chucking face when chucking the string. Therefore, the string can be more firmly chucked.

Figure 4:
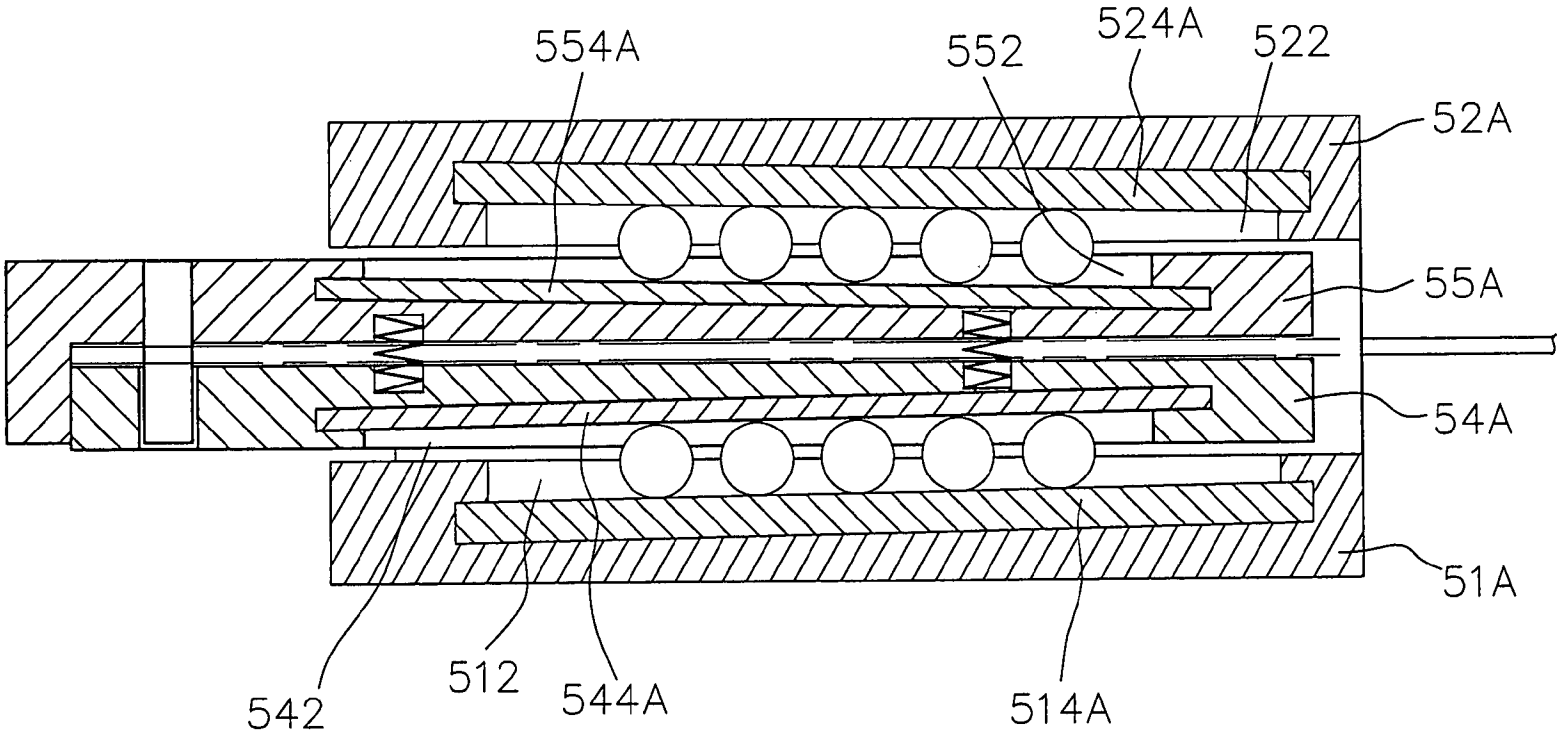
FIG. 4 is a sectional assembled view of a second embodiment of the string pulling head structure of the present invention.
Figure 5:
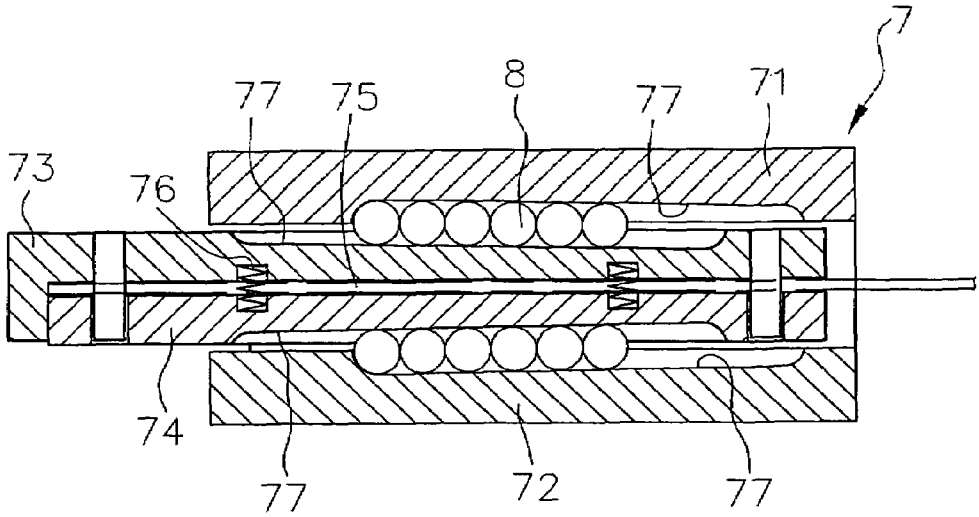
FIG. 5 PRIOR ART
FIG. 5 is a sectional view of the string pulling head of a conventional racket stringer.
Figure 6:
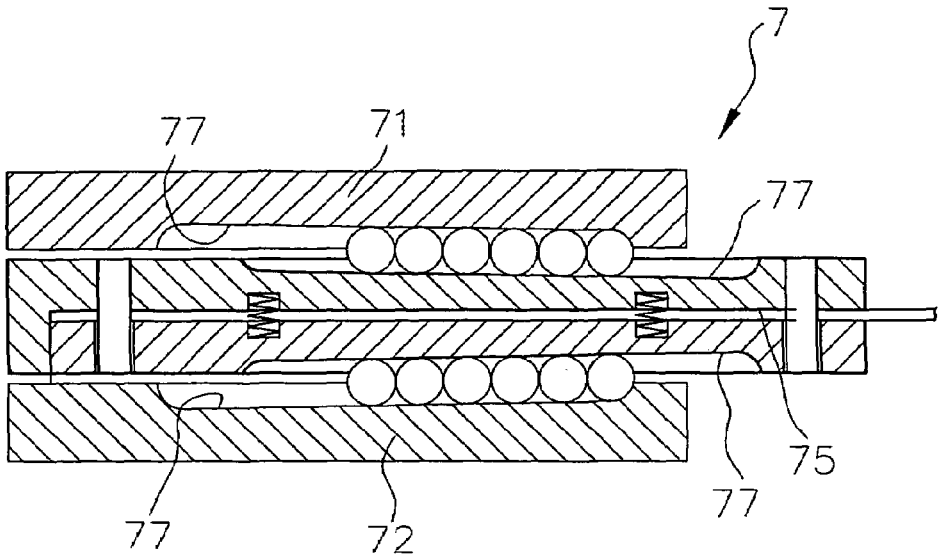
FIG. 6 PRIOR ART
FIG. 6 is a sectional view of the string pulling head of the conventional racket stringer, showing that the racket string is chucked with the string pulling head.
Figure 7:
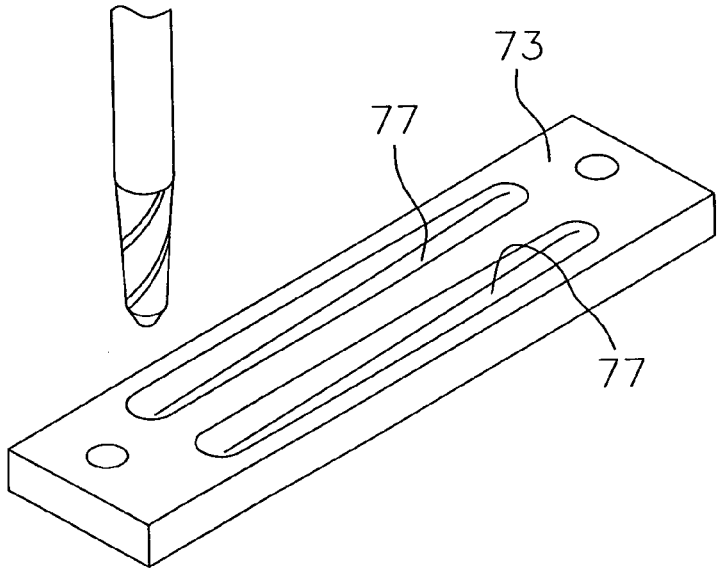
FIG. 7 PRIOR ART
FIG. 7 is a perspective view showing the manufacturing of the string pulling head of the conventional racket stringer.
Figure 8:
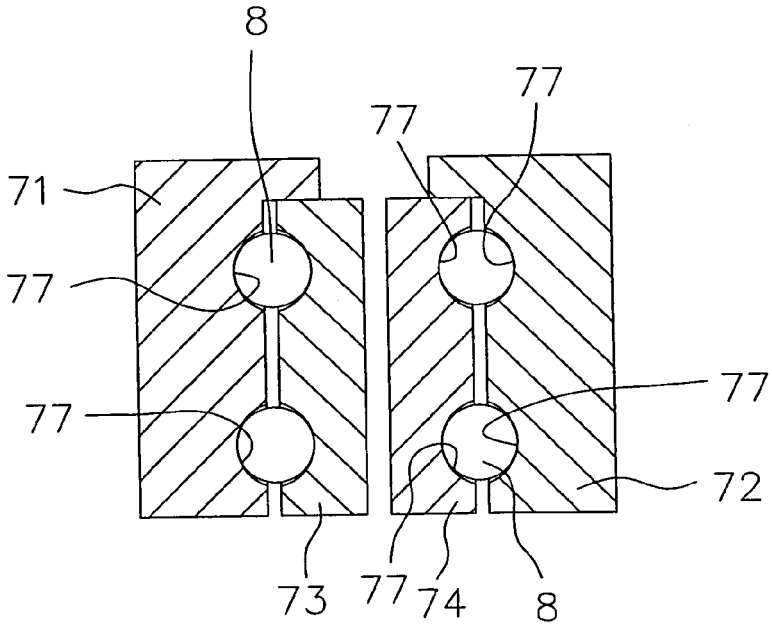
FIG. 8 PRIOR ART
FIG. 8 is a sectional view of the string pulling head of the conventional racket stringer, showing that the steel balls contact with the walls of the channels.

FIG. 4 shows a second embodiment of the present invention, in which the first string chuck 51A, the second string chuck 52A, the first chucking plate 54A and the second chucking plate 55A are made of engineering plastic by integral injection molding. The metal-made first slats 514A, 544A and second slats 524A, 554A are respectively placed in the molds for molding the first string chuck 51A, the second string chuck 52A, the first chucking plate 54A and the second chucking plate 55A. Then the first string chuck 51A, the second string chuck 52A, the first chucking plate 54A and the second chucking plate 55A are made by injection molding. Accordingly, the slats are inlaid in the string chucks and the chucking plates which are formed with slots. The slats serve as the bottoms of the slots. This can reduce the material cost and the manufacturing cost.

The above embodiments are only used to illustrate the present invention, not intended to limit the scope thereof. Many modifications of the above embodiments can be made without departing from the spirit of the present invention.

What is claimed is:

1. A string pulling head structure of a racket stringer, comprising:

a first string chuck and a second string chuck fixed with each other and a first chucking plate and a second chucking plate disposed between the first and second string chucks, outer faces of the first and second chucking plates respectively attaching to inner faces of the first and second string chucks, inner faces of the first and second chucking plates being respectively a first chucking face and a second chucking face, the first and second chucking faces defining therebetween a gap, the inner face of the first string chuck being formed with more than one first slot, the outer face of the first chucking plate being formed with more than one first slot mated with the first slot of the first string chuck, multiple ball members being accommodated in the first slots, the inner face of the second string chuck being formed with more than one second slot, the outer face of the second chucking plate being formed with more than one second slot mated with the second slot of the second string chuck, multiple ball members being accommodated in the second slots;

a first antiwear slat disposed on outer side of the first slot of the first string chuck to seal the outer side of the first slot and another first antiwear slat disposed on inner side of the first slot of the first chucking plate to seal the inner side of the first slot, the first slats serving as the bottoms of the first slots, the first slats being inclined by equal inclination angle but in reverse direction, whereby the depths of two ends of the first slots are unequal to each other; and a second antiwear slat disposed on outer side of the second slot of the second string chuck to seal the outer side of the second slot and another second antiwear slat disposed on inner side of the second slot of the second chucking plate to seal the inner side of the second slot, the second slats serving as the bottoms of the second slots, the second slats being inclined by equal inclination angle but in reverse direction, whereby the depths of two ends of the second slots are unequal to each other.

2. The string pulling head structure of the racket stringer as claimed in claim 1, wherein:

one side of each of the first slots of the first string chuck and the first chucking plate is formed with a first receiving section and a first depression, the first slats being respectively accommodated in the first receiving sections, two first cover boards being respectively disposed in the first depressions, the first slats being retained by the first cover boards on one side of the first slots of the first string chuck and first chucking plate to serve as the bottoms of the first slots; and one side of each of the second slots of the second string chuck and the second chucking plate is formed with a second receiving section and a second depression, the second slats being respectively accommodated in the second receiving sections, two second cover boards being respectively disposed in the second depressions, the second slats being retained by the second cover boards on one side of the second slots of the second string chuck and second chucking plate to serve as the bottoms of the second slots.

3. The string pulling head structure of the racket stringer as claimed in claim 2, wherein the first and second string chucks and the first and second chucking plates are all made of aluminum.

4. The string pulling head structure of the racket stringer as claimed in claim 2, wherein the first and second slats are iron boards.

5. The string pulling head structure of the racket stringer as claimed in claim 2, wherein each of the chucking faces of the first and second chucking plates has a hardened layer for enhancing the frictional force of the chucking faces when chucking the racket string.

6. The string pulling head structure of the racket stringer as claimed in claim 5, wherein the hardened layer is made of silica sand.

7. The string pulling head structure of the racket stringer as claimed in claim 1, wherein the first and second string chucks and the first and second chucking plates are made by integral injection molding, whereby the first and second slats are respectively wrapped by the first and second string chucks and the first and second chucking plates on outer sides of the first and second slots to serve as the bottoms thereof.

8. The string pulling head structure of the racket stringer as claimed in claim 7, wherein the first and second string chucks and the first and second chucking plates are all made of engineering plastic.

9. The string pulling head structure of the racket stringer as claimed in claim 7, wherein the first and second slats are iron boards.

10. The string pulling head structure of the racket stringer as claimed in claim 1, wherein a projecting block extends from a lower section of the second string chuck toward the first string chuck, whereby a slide way is defined between opposite inner faces of upper sections of the first and second string chucks, the first and second chucking plates being disposed in the slide way.

11. The string pulling head structure of the racket stringer as claimed in claim 1, wherein two springs and two guide posts are disposed between the first chucking face of the first chucking plat and the second chucking face of the second chucking plate for resiliently pushing and guiding the first and second chucking plates to attach to the inner faces of the first and second string chucks.

* * * * *